United States Patent [19]

Rossi

[11] 4,209,292

[45] Jun. 24, 1980

[54] FLUID STORAGE AND DISTRIBUTION ARRANGEMENT MOUNTED ON ROTARY REACTOR

[75] Inventor: Eugene F. Rossi, Wauwatosa, Wis.

[73] Assignee: Allis-Chalmers Corporation, Milwaukee, Wis.

[21] Appl. No.: 960,090

[22] Filed: Nov. 13, 1978

[51] Int. Cl.[2] ..... F27B 7/36

[52] U.S. Cl. ..... 432/105; 266/96; 432/109

[58] Field of Search ..... 432/26, 105, 109; 266/187, 173, 96; 239/417

[56] References Cited

U.S. PATENT DOCUMENTS

| | | | |
|---|---|---|---|
| 3,182,980 | 5/1965 | Helfrich | 432/109 |
| 3,794,483 | 2/1974 | Rossi | 432/109 |
| 3,847,538 | 11/1974 | Rossi | 432/26 |
| 3,945,624 | 3/1976 | Rossi | 432/187 |
| 3,946,949 | 3/1976 | Rossi | 266/265 |
| 4,076,176 | 2/1978 | Torrence | 137/209 |

FOREIGN PATENT DOCUMENTS

| | | | |
|---|---|---|---|
| 89131 | 8/1922 | Austria | 432/109 |

*Primary Examiner*—John J. Camby
*Attorney, Agent, or Firm*—Robert C. Sullivan; Arthur M. Streich

[57] ABSTRACT

An arrangement for storing and distributing a fluid on board a rotary reactor such as a rotary kiln. The application discloses a rotary reduction kiln for reducing a metallic oxide such as iron oxide to a lower state of oxidation. A liquid hydrocarbon is used as a reductant in the reduction process for the metallic oxide. The kiln includes a cylindrical chamber adapted to receive the charge of material which is being subjected to the reduction process. A plurality of rows of nozzles are mounted on and supported by the kiln in hydraulic communication with the interior of the reduction chamber. Flow of hydrocarbon liquid to each row of nozzles is controlled by a corresponding flow control valve in accordance with the position of the corresponding row of nozzles relative to the charge of material in the kiln. A plurality of hydro-pneumatic accumulators having the hydraulic sections thereof connected to a common manifold are mounted on and rotatable with the kiln. Each accumulator includes a pneumatic section which is precharged to a predetermined pneumatic pressure. The common manifold of the hydraulic sections of the plurality of accumulators is hydraulically connected to the plurality of rows of nozzles through a pressure regulating device and through corresponding flow control valves whereby to provide a liquid supply at a controlled pressure and flow rate to the nozzles when the corresponding control valves are in "On" position.

11 Claims, 5 Drawing Figures

FLUID STORAGE AND DISTRIBUTION ARRANGEMENT MOUNTED ON ROTARY REACTOR

TECHNICAL FIELD

This invention relates to a system and apparatus for storing and distributing a fluid which is adapted to be mounted on and to rotate with a rotary reactor such as a rotary kiln or the like. The invention will be described as embodied in a system and apparatus for storing a liquid fuel, such as liquid hydrocarbon or fuel oil, on board a rotary reduction kiln, and for distributing the liquid fuel to the nozzles of the rotary reduction kiln.

DESCRIPTION OF THE PRIOR ART

It is known in the prior art, as taught by U.S. Pat. No. 3,182,980 issued to Wayne J. Helfrich on May 11, 1965, to reduce a metallic oxide such as iron oxide to a lower state of oxidation by injecting a reductant such as a gaseous hydrocarbon fuel through kiln nozzles as they are passing beneath the charge or bed of metallic oxide in a rotating kiln, and also to inject into the kiln a gaseous oxidizing agent such as oxygen or air when the nozzles of the kiln are in an appropriate position such as above the bed of metallic oxide. It is also broadly known in the prior art to inject a liquid hydrocarbon such as fuel oil or the like into a rotary reduction kiln beneath a bed of metallic oxide, the liquid hydrocarbon serving as a reducing agent which causes a reduction of the metallic oxide to a lower state of oxidation. My prior U.S. Pat. No. 3,946,949 issued on Mar. 30, 1976, shows a nozzle suitable for injecting a liquid hydrocarbon such as fuel oil into the interior of a rotary reduction kiln beneath a bed of metallic oxide which is being reduced.

It has been known in the prior art relating to use of a hydrocarbon fuel or the like used as a reductant to reduce a metallic oxide such as iron oxide to a lower state of oxidation, to provide a stationary reservoir for the liquid hydrocarbon and to transfer the liquid hydrocarbon to the rotating reduction kiln by means of a rotary union which permits transfer of liquid from a stationary reservoir to a rotating utilization device such as a rotary reduction kiln. However, although liquid fuel can be transferred from a stationary reservoir to a rotary utilization device such as a rotary kiln by means of a rotary union, such an arrangement may create a space problem when used with a small kiln since the axially extending conduit which brings the liquid fuel on board the rotating kiln must extend through either the inlet end for the material to be processed or through the discharge end for the material which has been processed.

STATEMENT OF THE INVENTION

Accordingly, it is an object of the present invention to provide a system and apparatus for storing and distributing a fluid on a rotary reactor such as a rotary kiln or the like.

It is another object of the present invention to provide a system and apparatus for storing and distributing a liquid on a rotary reactor such as a rotary kiln or the like, which eliminates the need for continuously connecting the rotary reactor to a stationary nonrotating liquid supply.

It is still another object of the present invention to provide a system and apparatus for storing and distributing liquid to a rotary reactor such as a rotary reduction kiln, which system and apparatus is adapted to be mounted on and rotate with the rotary reactor.

It is a further object of the present invention to provide a liquid storage and distribution system and apparatus mounted on and rotatable with a rotary reactor, which system and apparatus is adapted for use in conjunction with an arrangement for metering precisely controlled quantities of liquid into the interior of the rotary reactor, and which liquid storage and distribution system and apparatus mounted on the rotary reactor can also be used independently of a liquid metering system if desired.

In achievement of these objectives, there is provided in accordance with the invention a rotary reactor comprising an elongated cylindrical chamber adapted to have a charge of material contained therein upon which a process is being performed in said chamber, a nozzle mounted on and supported by said rotary reactor in fluid communication with said chamber and adapted to dispense a fluid into said chamber required in connection with said process, a fluid flow control valve associated with said nozzle to control flow of fluid to said nozzle, said flow control valve being mounted on and rotatable with said rotary reactor, an accumulator mounted on and rotatable with said rotary reactor, means fluidly connecting said accumulator to said nozzle through said flow control valve whereby to provide a fluid supply to said nozzle when said flow control valve is in "On" position, conduit means carried by said rotary reactor and in fluid communication with said accumulator, said conduit means being adapted to detachably engage a stationary source of fluid supply positioned off said rotary reactor, whereby to permit charging said accumulator with fluid.

Further objects and advantages of the invention will become apparent from the following description taken in conjunction with the accompanying drawings in which:

DESCRIPTION OF THE PREFERRED EMBODIMENT

Figure 1:
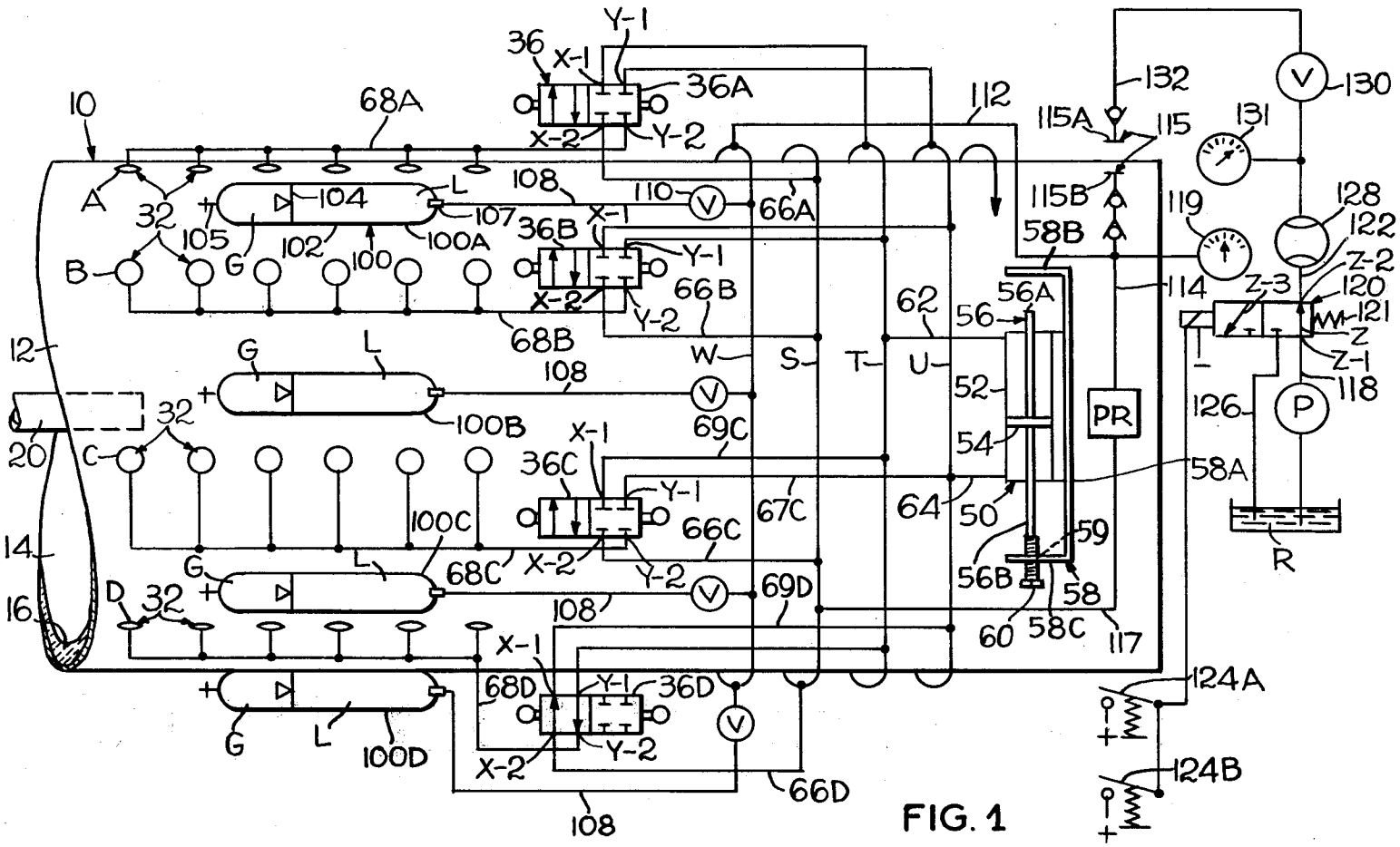
FIG. 1 is a view in elevation, partially schematic, of a rotary reduction kiln provided with a liquid fuel storage and distribution arrangement in accordance with the invention, the liquid storage and distribution arrangement of the invention being shown in association with a liquid metering arrangement for dispensing a predetermined precise quantity of liquid fuel to the nozzles of the rotary kiln.
Figure 2:
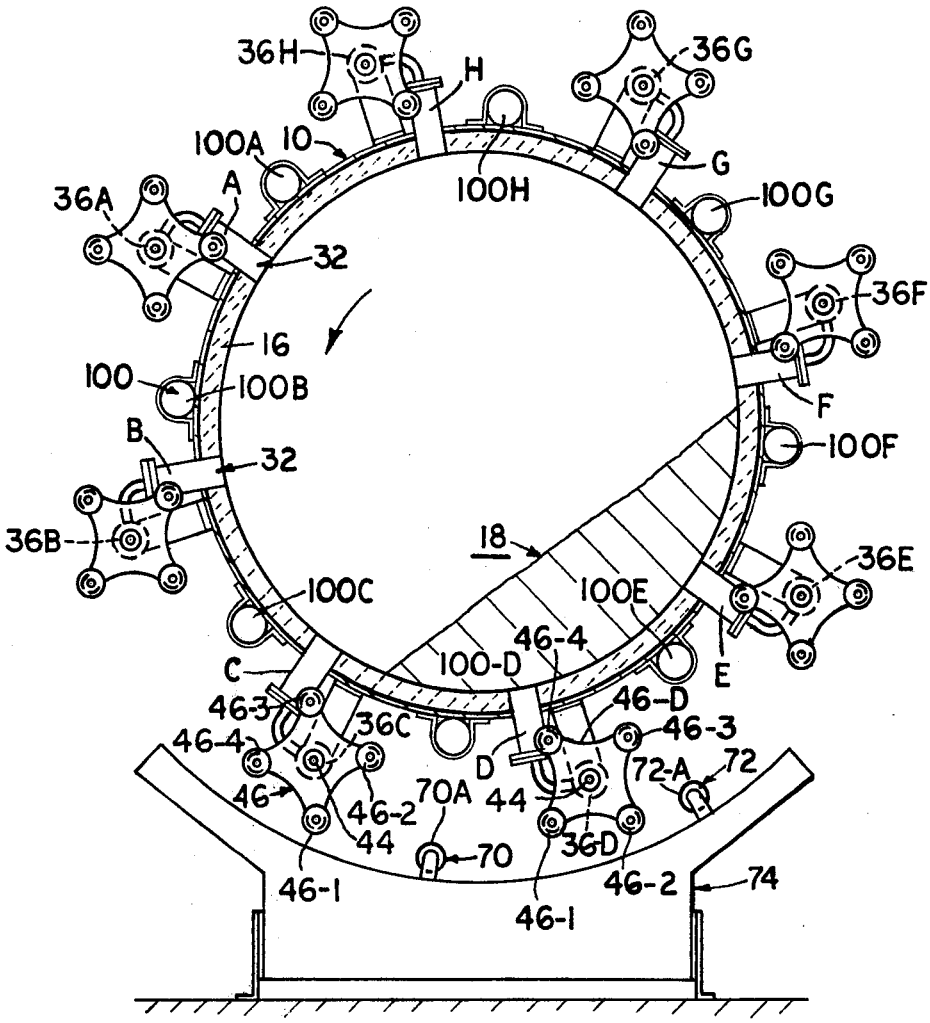
FIG. 2 is a partial transverse sectional view of a rotary reduction kiln having the liquid storage and distribution apparatus of the invention mounted thereon.
Figure 3:
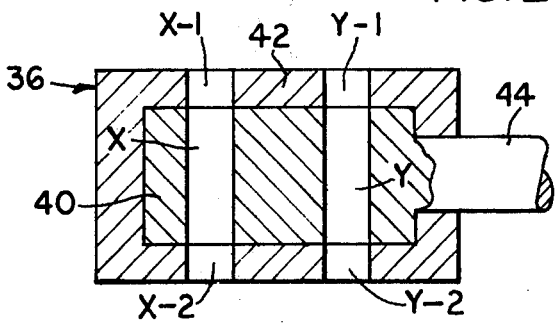
FIG. 3 is a view in longitudinal section of a flow control valve used in association with the liquid storage and distribution arrangement of FIGS. 1 and 2.

Referring now to FIGS. 1-3, inclusive, there is shown a rotary reduction kiln generally indicated at 10 which comprises an elongated cylindrical body portion 12 which defines a cylindrical reduction or combustion chamber 14. The general arrangement and construction of rotary kilns of this type are well known per se and are shown, for example, by such prior art patents as the aforementioned U.S. Pat. No. 3,182,980 issued to Wayne J. Helfrich, and also by my U.S. Pat. Nos. 3,794,483, 3,847,538 and 3,945,624. The shell or inner wall 16 of the kiln may be constructed of any suitable refractory material such as firebricks. Any well known means may be provided for supporting and rotating the kiln such as that shown, for example, by the aforementioned U.S. Pat. No. 3,182,980 of Wayne J. Helfrich. Since such means form no part of this invention and are well known in the art, they are not shown herein. A charge of metallic oxide to be reduced to a lower state of oxidation generally designated at 18 is shown in FIG. 2. In most cases, the metallic oxide 18 to be reduced would be an iron oxide in the form of lump ore or alternatively in the form of pellets. However, the metallic oxide to be reduced could also be an oxide of some other metal such as nickel.

A main burner 20 is provided at the left-hand end of the kiln relative to the views shown in the drawings to preheat the kiln, as is well known in the art. Main burner 20 is preferably stationary and kiln 10 rotates with respect to the stationary burner. The construction or arrangement of main burner 20 has no connection or relation with the present invention.

A plurality of inlet nozzles 32 are mounted on kiln 10, each nozzle 32 extending from the exterior of kiln 10 through the refractory wall 16 of the kiln and into communication with the interior of the kiln where the nozzles are so positioned as to inject the hydrocarbon liquid such as fuel oil the bed 18 of ore or pellets as the respective nozzles rotate or pass under the bed 18 as will be described more fully hereinafter. The nozzles generally indicated at 32 may be of the type shown in my prior U.S. Pat. No. 3,946,949 referred to hereinbefore. As best seen in the views of FIGS. 1 and 2, the plurality of nozzles 32 in the particular embodiment shown are arranged in eight rows A–H, inclusive, extending longitudinally of the kiln in a direction parallel to the axis of rotation of the kiln, with the respective rows of nozzles being arcuately spaced apart 46 degrees from each other relative to the circumference or periphery of the kiln.

Each of the axially extending rows of nozzles A–H, inclusive, in the illustrated embodiment is shown as including six nozzles. The plurality of nozzles in a given row, such as row A, are connected to a fluid manifold such as that indicated at 68A for row A. Manifold 68A supplies the liquid hydrocarbon to each of the nozzles 32 in the given row such as row A. A corresponding flow control valve generally indicated at 36 mounted on and rotatable with kiln 10 is provided to control the flow of liquid fuel to each of the nozzles 32 in a given longitudinal row of nozzles such as row A, B, etc., the specific flow control valve 36 for each of the respective rows, A, B, etc., being designated by the reference number "36" together with a letter corresponding to the row of nozzles controlled by the particular flow control valve, as, for example, 36A, 36B, 36C, etc.

As best seen in the view of FIG. 3, valve 36 in the illustrated embodiment comprises a cylindrical spool member 40 which is received within and adapted to rotate within a housing or casing 42. Spool member 40 includes a stem portion 44 which extends through the end wall of casing 42. Suitable seal or packing means (not shown) prevents leakage where stem portion 44 extends through casing 42. Spool member 40 of valve 36 is provided with two passages indicated at X and Y which extend diametrically through spool 40 in longitudinally spaced relation to each other. Casing 42 includes a first set of aligned diametrically opposite ports indicated at X-1 and X-2 which are adapted to align with passage X in the rotatable spool member 40 when spool 40 is in the position shown in the view of FIG. 3 and also when spool 40 is rotated 180 degrees from the position shown in the view of FIG. 3. Similarly, casing 42 is also provided with aligned diametrically opposite ports indicated at Y-1 and Y-2 which are adapted to be aligned with passage Y through valve spool 40 when spool 40 is in the position shown in the view of FIG. 3 and also when spool 40 has been rotated 180 degrees from the position shown in the view of FIG. 3. An operating member or cam plate generally indicated at 46 (FIG. 2) having four radially extending cam arms indicated at 46-1, 46-2, 46-3, and 46-4 is attached to the outer end of stem portion 44. Cam arms 46-1 through 46-4, inclusive, are respectively separated from each other by an angle of 90 degrees. As will be explained in more detail hereinafter, cam arms 46-1 through 46-4, inclusive, cooperate with trip members 70 and 72 which are abutments located along the peripheral path of rotation of kiln 10 to cause the rotation of valve spool 40 within valve housing 42 whereby to control flow of liquid fuel through valve 36 in a predetermined manner.

Description of Metering Cylinder

As described in my U.S. patent application, Ser. No. 960,091, filed concurrently with the present application, a metering cylinder and piston assembly generally indicated at 50 is provided and is suitably mounted on the exterior surface of the rotary reduction kiln so as to rotate with the kiln. The assembly 50 comprises a cylinder member 52 and a "floating" piston member 54 which is linearly movable within cylinder 52. A rod member 56 is fixed to and projects through piston 54 and extends equal distances on the opposite sides of piston 54 whereby rod portions 56A and 56B on opposite sides of piston 54 are of equal length. Rod member 56 moves with piston 54. The opposite ends of rod 56 project through and are movable through suitably sealed passages in the opposite end walls of cylinder 52.

An elongated bracket member generally indicated at 58 is suitably secured to the outer surface of cylinder 52. Bracket 58 includes an elongated portion 58A which is secured to the outer surface of cylinder 52 and extends longitudinally of the longitudinal axis of cylinder 52. Bracket 58 also includes a pair of oppositely disposed end or leg portions 58B and 58C which extend perpendicularly to the elongated bracket portion 58A. Lower leg portion 58C of bracket 58 is provided with a threaded passage 59 which receives an adjusting screw 60 which serves as an adjustable stop for the lower end of rod 56 with respect to the view shown in FIG. 1. Upper leg portion 58B of bracket 58 serves as a stop for the opposite or upper end of rod 56 with respect to the view in FIG. 1.

Adjusting screw 60 is adjusted in threaded passage 59 to adjust the stroke of the piston 54 to provide the desired metered quantity of hydrocarbon fuel on each stroke of the piston. For any given position of adjusting screw 60, the stroke of piston 54 is the same in each direction, so that the same metered volume of liquid fuel is delivered by metering piston 54 from cylinder 52 in both directions of movement of piston 54 in any adjusted position of adjusting screw 60.

The space in cylinder 52 above floating piston 54, relative to the view shown in FIG. 1, is connected by conduit 62 to a circular manifold T which is carried by and encircles rotary kiln 10. Similarly, the space inside cylinder 52 beneath piston 54 is connected by means of conduit 64 to still another circular manifold U which is also carried by and encircles rotary kiln 10.

In examining the schematic arrangement of FIG. 1, it will be noted that the port X-2 of each of the flow control valves 36A–36D, inclusive, is connected by a conduit 66A, 66B, etc. to the fuel supply manifold S. It will also be noted that the port Y-2 of each of the flow control valves 36A–36D, inclusive, is connected by a corresponding manifold conduit 68A, 68B, etc. to the inlet of each of the plurality of nozzles 32 in each particular row of nozzles corresponding to the respective flow control valves 36A–36D, inclusive.

Referring to the schematic arrangement shown in FIG. 1, it will also be noted that the X-1 port of flow control valve 36A corresponding to row A of nozzles 32 is connected to circular manifold T which in turn is connected by conduit 62 to the upper end of the interior of metering cylinder 52 above piston 54. The next successive flow control valve 36B, corresponding to row B of nozzles 32, has the port X-1 thereof connected to circular manifold U which in turn is connected by conduit 64 to the lower end of the interior of cylinder 52 beneath the movable piston 54. Port X-1 of the next successive flow control valve 36C corresponding to row C of nozzles 32 is connected to circular manifold T and thus to the upper end of the interior of hydraulic metering cylinder 52; whereas port X-1 of the next flow control valve 36D which corresponds to row D of nozzles 32 is connected to manifold U and thus to the lower end of the interior of cylinder 52. Thus, it will be seen that the X-1 ports of successive flow control valves 36A, 36B, 36C, 36D, and similarly for the remaining flow control valves 36E–H, inclusive, not shown in FIG. 1, corresponding to the rows of nozzles E–H, inclusive, are connected alternately to the circular manifolds T and U and thus are connected alternately to the upper end and to the lower end of the interior of metering cylinder 52, respectively, above and below floating piston 54.

In a similar manner, it will be noted that port Y-1 of flow control valve 36A corresponding to row A of nozzles 32, is connected to manifold U and thus to the lower end of the interior of hydraulic cylinder 52, whereas port Y-1 of the next successive flow control valve 36B corresponding to row B of nozzles 32 is connected to circular manifold T and thus to the upper end of the interior of hydraulic cylinder 52 above floating piston 54. In a similar manner, port Y-1 of each of the remaining flow control valves 36C–36H, inclusive, is connected alternately to manifolds U and T and thus alternately to the lower end of the interior of hydraulic cylinder 52 and to the upper end of the interior of hydraulic cylinder 52. In any given flow control valve, such as 36A, 36B, etc., the X-1 port and the Y-1 port are always connected to opposite ones of the circular manifolds T and U. Thus, for example, in the case of flow control valve 36A, the X-1 port is connected to the T manifold and thus to the upper end of hydraulic cylinder 52 and the Y-1 port is connected to circular manifold U and thus to the lower end of hydraulic cylinder 52.

Description of Liquid Storage System

As seen in the view of FIGS. 1 and 2, a plurality of hydro-pneumatic accumulators generally indicated at 100 and specifically indicated at 100A–100H, inclusive, are mounted on the exterior surface of rotary kiln 10 in arcuately or circumferentially spaced relation to each other, and rotate with kiln 10. Accumulators 100 are of the floating piston type. Each accumulator 100 includes an outer shell 102 having positioned on the interior thereof a "floating" piston 104. The interior of accumulator shell 102 is in fluid communication at the left-hand end thereof relative to the view in FIG. 1 with a corresponding gas inlet fitting 105 through which a suitable gas such as nitrogen, for example, may be introduced into the hollow space G in shell 102 to the left of piston 104 relative to the view of FIG. 1 whereby to precharge space G to a predetermined gas pressure. The gas precharge is applied to space G in each accumulator before the kiln is placed in operation, with the source of gas supply for precharging the space G of each accumulator being disconnected before kiln 10 is placed in operation. Suitable seal means at the peripheral edge of floating piston 104 insures that there is no interchange of fluid between the gas-filled space G on the left-hand side of piston 104 relative to the view in FIG. 1, with the liquid-filled space L on the right-hand side of piston 104, relative to the view in FIG. 1. Accumulators of the floating piston type are per se well known in the prior art, an accumulator of this type being shown and described, for example, by U.S. Pat. No. 4,076,176 issued to James D. Torrence on Feb. 28, 1978. While the invention has been illustrated using a hydro-pneumatic accumulator of the "floating piston" type, it is also within the scope of the invention to use a hydro-pneumatic accumulator of the well known bladder type such as that also shown and described by the aforementioned U.S. Pat. No. 4,076,176 of James D. Torrence.

The hollow space L in each accumulator 100 on the right-hand side of piston 104 relative to the view in FIG. 1 is suitably connected through a suitable hydraulic inlet fitting 107 to an inlet line 108 in series with a shut-off valve 110 to a circular manifold W which extends circumferentially around the entire periphery of kiln cylinder 12. All of the plurality of accumulators 100A–100H, inclusive, have the hydraulic portions L thereof hydraulically connected in parallel with each other to manifold W. Manifold W in turn is connected by a conduit 112 on kiln 10 to the conduit 114 on kiln 10 leading from kiln-mounted portion 115B of the quick detachable coupling arrangement generally indicated at 115 to be described. Conduit 112 between manifold W and conduit 114 is connected to conduit 114 upstream of the adjustable pressure regulating device indicated at PR which is mounted on and rotatable with rotary kiln 12. The adjustable pressure regulating device PR can be adjusted to convert a high input hydraulic pressure to a predetermined relatively low hydraulic pressure corresponding to a desired hydraulic flow rate to nozzles 32. Thus, the adjustable pressure regulating device PR serves to reduce the liquid pressure from some high value which might initially be of the order of magnitude of 1500 pounds per square inch as it is initially supplied by accumulators 100 to manifold W to a much lower regulated pressure value such as a pressure of 10 to 15 pounds per square inch as it is supplied to the nozzles 32 by supply manifold S. The hydraulic pressure at the junction of conduits 112 and 114 is measured by a hydraulic pressure gauge 119. As accumulators 100 continue to supply liquid hydrocarbon to nozzles 32 and the supply of liquid hydrocarbon in accumulators 100 diminishes, the pressure reading of pressure gauge 119 will decrease. However, the adjustable pressure regulating device PR will continue to maintain a substantially constant regulated pressure, such as, for example, 10 pounds per square inch in fuel supply manifold S leading to nozzles 32. The relatively low output pressure maintained by pressure regulating device PR is adjusted to provide a substantially constant predetermined desired liquid flow rate to manifold S and thus to the particular nozzles 32 connected to manifold S at any given time.

As seen in FIG. 1, a liquid fuel such as a liquid hydrocarbon or fuel oil is derived from a stationary "off-the-kiln" supply source which includes a liquid fuel reservoir R, and a pump P for pumping liquid from reservoir R. The output line 118 of pump P is connected to a port Z-1 in the stationary housing of a solenoid-operated valve generally indicated at 120. The stationary housing of valve 120 also includes a port Z-2 which is connected to the output conduit 122 leading to a flexible high pressure hose 132. Valve 120 includes a movable valve element having a passage Z therein. Valve 120 is normally biased by spring 121 to a position in which passage Z in the movable valve element communicates with ports Z-1 and Z-2 when valve 120 is in the position shown in the view of FIG. 1, whereby the output of pump P passes from output conduit 118 of pump P, through port Z-1 of valve 120, through valve passage Z, and through valve port Z-2 to valve output conduit 122. Valve output conduit 122 is connected in series with a flow sensing device 128 and a high pressure shut-off valve 130 to high pressure flexible hose 132. A pressure gauge 131 measures the hydraulic pressure in output conduit 122 leading from solenoid-operated valve 120 to flexible high pressure hose 132. The free end of high pressure flexible hose 132 terminates in a coupling section 115A which is adapted to detachably engage a mating coupling section 115B mounted on and rotatable with kiln 10. The two coupling sections 115A and 115B together constitute the quick detachable coupling generally indicated at 115.

When the output of pump P is actually connected in hydraulic charging relation to the plurality of accumulators 100A–100H, inclusive, through the quick detachable coupling 115 for flexible high pressure hose 132, solenoid valve 120 is in the position shown in FIG. 1 of the drawings in which passage Z of the movable valve element of solenoid valve 120 communicates with stationary ports Z-1 and Z-2 of valve 120 whereby to permit the output of pump P to flow through valve 120 and through output conduit 122 to the flexible high pressure hose 132 and thus through the closed quick detachable coupling or connection 115 defined by coupling sections 115A and 115B to conduit 112 onboard rotating kiln 10, and thus to manifold W for the plurality of hydro-pneumatic accumulators 100, and thence through the respective inlet lines 108 of the plurality of hydraulic accumulators 100 whereby to charge up accumulators 100 to the desired pressure such as 1500 pounds per square inch. However, during the actual connecting and disconnecting operations between quick detachable coupling sections 115A (on the hose) and 115B (on the kiln), it is important that the output of pump P be bypassed back to reservoir R rather than having the high liquid pressure developed by pump P, such as 1500 pounds per square inch, at the coupling section 115A on the free end of flexible hose 132 during the actual connection or disconnection of coupler sections 115A and 115B, since the presence of such high pressure at coupling section 115A on the hose makes it extremely difficult if not impossible either to make the connection or to make the disconnection between the two coupling sections 115A and 115B.

In order to cause the output of pump P to be bypassed back to reservoir R as just described, a pair of parallel-connected switch members 124A and 124B are provided in the electrical circuit of electrically operated solenoid valve 120 whereby actuation of either of the switch members 124A or 124B causes the electrical energization of solenoid valve 120 whereby to cause the movable valve element of solenoid valve 120 to move against the biasing force of spring 121 to a position in which the output of pump P is bypassed through valve passage Z-3 to conduit 126 which discharges the pump output to reservoir R. Switch members 124A and 124B may be of the foot pedal-operated type and are located on opposite sides of the rotary kiln. In the description of the quick disconnect coupling and uncoupling operations, it is assumed that switch 124A is used by Operator No. 1 on the side of the kiln where the coupler members 115A and 115B are first engaged or coupled with each other, and that switch 124B is located on the opposite side of the kiln where coupler members 115A and 115B are disengaged from each other.

The quick detachable hydraulic coupler 115 may be a commercially available type such as that manufactured by the Pioneer Division of Parker Hannifin Company under the designation "Pioneer—Series 8000 Pressurematic Hydraulic Coupler."

Procedure for Charging the Accumulators

In normal operation of the rotary kiln, the plurality of accumulators 100 constitute a self-contained "onboard" storage arrangement for the liquid hydrocarbon fuel which is fed through nozzles 32 of the kiln to serve as a reductant for the charge of metallic oxide, such as iron oxide, the state of oxidation of which is to be reduced. However, accumulators 100 must be periodically recharged with the liquid hydrocarbon fuel, and typically such recharging might be necessary at four hour intervals during the continuous operation of the kiln.

The need for recharging accumulators 100 is indicated by pressure gauge 119 which is located at the junction of conduit 112 leading from accumulator manifold W with conduit 114 leading to pressure regulator PR. For an accumulator of a given internal volume, and knowing the initial gas precharge pressure in the accumulators, the amount of liquid remaining in the respective accumulators for any given pressure reading of pressure gauge 119 can be obtained from available pressure-volume curves, thereby indicating when the accumulators require recharging with the hydrocarbon liquid.

When it is necessary to recharge accumulators 100, pump P is energized to begin pumping the hydrocarbon liquid from reservoir R to valve 120 and the pump output pressure as measured at pressure gauge 131 is raised to the desired value such as 1500 pounds per square inch to which it is desired to charge accumulators 100.

When Operator No. 1, who is assumed to be the operator positioned on one side of the rotating kiln who completes the detachable coupling 115 between coupler sections 115A on flexible hose 132 and 115B on the rotating kiln, is in the process of actually engaging the two coupler sections 115A and 115B, he closes foot pedal switch 124A in the electrical circuit of solenoid valve 120 whereby to move solenoid valve 120 to the dumping position previously explained in which the output of pump P is bypassed through valve passage Z-3 and conduit 126 back to reservoir R. The quick detachable connection 115 may be completed and accumulators 100 are charged with liquid hydrocarbon while the kiln is rotating at its normal speed such as 0.5 revolution per minute.

As soon as Operator No. 1 has completed the mechanical connection of coupler section 115A on flexible hose 132 with coupler section 115B on the rotating kiln, he removes his foot from switch 124A in the circuit of solenoid valve 120, causing electrical deenergization of solenoid valve 120. When solenoid valve 120 is electrically deenergized, biasing spring 121 mechanically moves valve 120 to the position shown in FIG. 1 in which the hydraulic output of pump P flows through valve 120 to flexible conduit 132 and thus through conduit 112 to manifold W and from manifold W into the liquid section L of the respective accumulators 100, whereby to hydraulically charge the accumulators.

With the quick detachable coupling completed between coupler sections 115A and 115B as just explained, and with solenoid valve 120 electrically deenergized, the liquid hydrocarbon flows through flexible hose 132 to charge accumulators 100 as kiln 10 slowly rotates through a rotary angle of in excess of 180 degrees with flexible hose 132 connected to the rotating kiln. Operator No. 2 is stationed on the opposite side of the rotating kiln so that when quick detachable connection 115 reaches the opposite sides of the kiln from the location where it was initially attached by Operator No. 1, Operator No. 2 who stands in readiness to detach flexible hose 132 from the kiln steps on foot pedal switch 124B to close switch 124B which is electrically connected in parallel with foot pedal switch 124A. Closure of switch 124B again energizes solenoid valve 120 to cause valve 120 to move to "dumping" position as previously described so that the output of pump P is bypassed by solenoid valve 120 back to reservoir R while Operator No. 2 is actually physically disconnecting flexible hose 132 at the quick disconnect coupling.

After Operator No. 2 has detached high pressure flexible hose 132 from the rotating kiln at the quick detachable coupling 115 as just described, he then removes his foot from foot pedal switch 124B to open switch 124B in the electrical circuit of solenoid valve 120, thereby deenergizing solenoid valve 120. Deenergization of solenoid valve 120 permits spring 121 to return valve 120 to the position shown in FIG. 1 in which the output of pump P is connected through valve passage Z to high pressure hose 132. There is no objection to having the output of pump P connected to hose 132 even though hose 132 is not connected to kiln 10. As previously explained, it is only necessary that the output of pump P be disconnected from high pressure hose 132 only during the actual coupling or uncoupling operations of the two coupling sections 115A and 115B. This charging procedure just described may have to be repeated several times or more before accumulators 100 have become completely charged, as indicated by a predetermined pressure reading such as 1500 pounds per square inch on pressure gauge 119.

During the time interval in which pump P is connected in charging relation to accuulators 100 through the connection of flexible hose 132 to kiln 10 as just described, the liquid hydrocarbon continues to flow through pressure regulator PR to nozzles 32.

DESCRIPTION OF OPERATION OF EMBODIMENT OF FIGS. 1-3, INCLUSIVE

It is assumed that the liquid section L of each accumulator 100 is sufficiently charged with the liquid hydrocarbon fuel or the like, and that the gas pressure in the pneumatic section G of each respective accumulator 100 serves to eject liquid fuel from the accumulators into the circular manifold W to which all of the accumulators are connected. The high pressure liquid in manifold W passes through conduit 112 to conduit 114 leading to pressure regulator PR which reduces the pressure of the liquid coming from manifold W from a high value such as 1500 pounds per square inch to a much lower value such as 10 to 15 pounds per square inch suitable for dispensing the liquid fuel at a predetermined desired flow rate to flow control valves 36 and thus to metering cylinder 52. Pressure regulator PR also maintains a substantially uniform hydraulic pressure and flow rate to valves 36 and thus to metering cylinder 52 as the pressure in accumulators 100 decreases as the quantity of liquid in accumulators 100 diminishes. The low pressure liquid fuel exiting from pressure regulator PR passes through conduit 117 to manifold S which distributes the liquid fuel to flow control valves 36A-36H, inclusive, which control flow of liquid fuel to nozzles 32.

It is also assumed that the stroke of piston 54 in metering cylinder 52 has been adjusted by means of adjusting screw 60 to provide the predetermined desired metered quantity of liquid hydrocarbon fuel on each stroke of piston 54 in metering cylinder 52, as previously described. As previously pointed out, for any given adjustment of the stroke of piston 54, an equal volume of liquid fuel is delivered in each direction of movement of piston 54. The flow rate of the liquid hydrocarbon fuel from pressure regulating device PR to supply manifold S and thus to the respective flow control valves 36 when in "On" position and thus to metering cylinder 52 should be such that the rate of movement of piston 54 in cylinder 52 is such that piston 54 completes its stroke during the time interval in which a given flow control valve 36 is in the "On" position. This insures that the predetermined measured quantity of fuel is completely dispensed from metering cylinder 52 while flow control valve 36 is in "On" position.

Referring now to FIG. 2, which shows rotary kiln 10 rotating in a counterclockwise direction as shown by the arrow in FIG. 2, it will be seen that an "On" trip member generally indicated at 70 and "Off" trip member generally indicated at 72 are mounted on a support bracket generally indicated at 74 which is supported on the ground or floor surface beneath the lower portion of kiln 10. Bracket 74 includes an arcuate surface 76 which lies on a radius drawn from the center of rotation of kiln 10. The respective trip members 70 and 72 include roller members 70A and 72A, respectively, which are abutments adapted to be engaged by cams 46-1 through 46-4, inclusive, carried by cam plate 46 secured to stem portion 44 of each respective flow control valve 36.

The two trip members 70 and 72 are so located relative to the path of rotation of kiln 10 and of the cam plate members 46 associated with the respective flow control valves 36 that as each respective row A, B, C, etc. of nozzles 32 moves to a predetermined position underneath the bed 18 of metallic oxide which may be in the form of ore or in the form of pellets, one of the cams 46-1, 46-2, 46-3, 46-4 of the cam plate 46 associated with each respective flow control valve 36A, 36B, etc. associated with the respective rows of nozzles will engage the "On" trip member 70. The engagement of cam plate 46 with "On" trip member 70 will cause a 90 degree circumferential movement of cam plate 46 to cause the corresponding flow control valve 36 to be moved to "open" position whereby to deliver a predetermined metered quantity of fuel oil or the like from metering cylinder 52 and through the corresponding bank of nozzles 32.

In a similar manner, when one of the cams 46-1, 46-2, etc. of a given cam plate 46 associated with a particular flow control valve 36A, 36B, etc. engages the "Off" trip member 72, the engagement of the cam with the "Off" trip member will cause another 90 degree circumferential movement of the given cam plate 46 to cause the corresponding flow control valve 36 to be moved to "closed" position whereby to terminate flow of fuel oil through the corresponding flow control valve 36 and through the corresponding row of nozzles.

It will be noted that in the position of rotary kiln 10 shown in FIG. 2 the row of nozzles D is already under the bed of metallic oxide 18. During the early part of the movement of the row of nozzles D under the bed of material 18, cam 46-1 on cam plate 46D for the rotary spool 40 of the corresponding flow control valve 36D engaged the abutment defined by fuel-on trip member 70 causing cam 46-1 to rotate in a clockwise direction relative to the view in FIG. 2, thereby rotating cam plate 46D and the stem 44 connected to rotatable valve spool 40 of flow control valve 36D through an angle of 90 degrees. The 90 degree movement imparted to cam plate 46D and stem 44 caused valve spool 40 to rotate into a position such as that shown in FIG. 3 of the drawings in which passages X and Y of valve spool 40 of valve 36D are respectively in alignment with ports X-1 and X-2 in the case of valve passage X, and are in alignment with ports Y-1 and Y-2 in the case of valve passage Y. Since, as seen in FIG. 1, port X-2 of valve 36D is connected to circular fuel supply manifold S which is mounted on the rotary kiln, the "fuel-on" position of flow control valve 36D causes the hydrocarbon liquid such as fuel oil to flow from circular supply manifold S through conduit 66D to port X-2 of the housing 42 of valve 36D, thence through passage X of valve spool 40 to the diametrically oppositely disposed port X-1 of the valve housing 40, thence through conduit 69D to circular manifold U which is mounted on and carried by the rotary kiln, thence through circuit 64 to the lower end of hydraulic cylinder 52 to cause piston 54 to move upwardly in cylinder 52 until the end of upper piston rod portion 56A (as viewed in FIG. 1) abuts against stop member 58B defined by the upper end portion of bracket 58 relative to the view shown in FIG. 1. This upward movement of piston 54 in cylinder 52 causes hydrocarbon liquid which is already present in the upper portion of metering cylinder 52 to be ejected through conduit 62 to circular manifold T and thus to port Y-1 of valve housing 42 to valve 36D, thence through flow passage Y in rotary spool 4D of valve 36D, thence through port Y-2 in valve housing 42 of valve 36D and into manifold passage 68D to supply a pulse of liquid hydrocarbon to the plurality of nozzles in row D as the nozzles in row D are moving under the bed 18 of ore or pellets.

As kiln 10 continues to rotate in a counterclockwise direction with respect to the view in FIG. 2, with consequent rotation of row D of nozzles 32 in a counterclockwise direction under the bed 18 of material, cam member 46-2 on cam plate 46 of valve 36D will engage the abutment defined by "Off" trip member 72, causing stem member 44 and the attached rotary valve spool 40 of flow valve 36D to rotate through another angle of 90 degrees to a position in which passages X and Y in the valve spool are no longer in alignment with ports X-1, X-2 and Y-1, Y-2 in valve housing 42. Thus, flow control valve 36D after passing by "Off" trip member 72 will no longer be open to the flow of hydrauic fluid therethrough.

The next successive row C of nozzles 32 and the flow control valve 36C associated therewith next approaches the "On" trip member 70 in the same manner as previously described and cam member 46-1 of cam plate 46C associated with flow control valve 46C will engage the abutment defined by "On" trip member 70 and will rotate stem member 44 and valve spool 40 of flow control valve 46C through an angle of 90 degrees to move flow control valve 46C to the "On" position similar to that shown in the view of FIG. 3 in which valve passage X is in alignment with ports X-1 and X-2 and valve passage Y is in alignment with ports Y-1 and Y-2.

From an examination of the schematic valving and hydraulic flow distribution diagram of FIG. 1, it can be seen that when flow control valve 36C is in the "On" position the liquid hydrocarbon fuel will flow from main fuel supply manifold S through conduit 66C to port X-2 of flow contol valve 36C, thence through flow passage X of rotary spool 40 of valve 36C, to port X-1 of valve 36C, thence through conduit 69C to circular manifold T, thence through conduit 62 to the upper end of hydraulic cylinder 52, causing piston 54 to move downwardly in cylinder 52 to eject a predetermined metered quantity of liquid through conduit 64 to circular manifold U from whence the measured and metered quantity of hydraulic fluid ejected from cylinder 52 then passes through conduit 67C to port Y-1 of flow control valve 36C, thence through flow passage Y in rotatable spool 40 of flow control valve 36C, thence to port Y-2 of flow control valve 36C and thence into manifold passage 68C which distributes the metered quantity of liquid hydrocarbon fuel to each of nozzles 32 in row C of nozzles as the nozzles in row C are passing under the bed of material 18.

When cam member 46-2 of cam plate 46 associated with flow control valve 36C reaches the "Off" trip member 72, cam plate 46 will be rotated through an angle of 90 degrees in the same manner as previously described to cause rotatable spool 40 of flow control valve 36C to rotate to an "Off" position in which the hydrcarbon fuel no longer passes through flow control valve 36C, all in the same manner as previously described in connection with flow control valve 36D.

Thus, it will be seen that as each successive circumferentially spaced row of nozzles 32 reaches a predetermined location under the bed 18 of material to be reduced, a cam on the associated cam plate 46 will be engaged by the abutment defined by "On" trip 70 to rotate valve spool 40 of the associated flow control valve 36A, 36B, etc. to the "On" position in which hydrocarbon liquid is admitted from circular fuel supply manifold S to port X-2 of the corresponding flow control valve 36, permitting liquid hydrocarbon fuel to pass through the flow passage X of the flow control valve to the oppositely disposed port X-1 of the valve housing from whence the hydrocarbon liquid is admitted to one end or the other of metering cylinder 52. The hydraulic connections of alternate flow control valves 36 corresponding to alternate rows of nozzles 32 to metering cylinder 52 are alternated in such manner as to cause liquid hydrocarbon fuel to be admitted to and ejected from alternate ends of metering cylinder 52, whereby to cause piston 54 to be moved in one direction in cylinder 52 when one row of nozzles is passing under the bed of material 18 and to cause piston 54 to move in the opposite direction when the next successive row of nozzles is passing under the bed of material 18. Thus, the metered quantity of liquid hydrocarbon is admitted to and ejected from alternate ends of metering cylinder 52 as successive rows of nozzles 32 pass under the bed of material 18. The liquid fuel which passes through ports X-1, X-2 and valve passage X of each respective flow control valve 36 is in a first hydraulic path or circuit which causes piston 54 to move in cylinder 52, while the liquid fuel which passes through ports Y-1, Y-2 and valve passage Y of each respective flow control valve 36 is in a second hydraulic path or circuit which delivers the liquid fuel to the corresponding row of nozzles.

It will also be noted that since each flow control valve 36 is indexed or rotated 90 degrees from an "Off" position to an "On" position in passing "On" trip member 70 and is then indexed or rotated an additional 90 degrees in moving from "On" back to "Off" in passing "Off" trip member 72, for a total of 180 degrees on one on-off cycle of valve 36, rotary spool 40 of valve 36 will then be so positioned as to move to "On" position when it is again indexed or rotated another 90 degrees upon passing "On" trip member 70 on the next rotation of kiln 10.

It will also be noted that the position of the "On" trip member 70 and of the "Off" trip member 72 must be so related to each other and to the spacing between successive circumferentially spaced flow control valves such as 36D and 36C that flow control valve 36D must have been actuated to "Off" position before the next successive flow control valve 36C is actuated to "On" position.

It is fundamental to the operation of the liquid fuel metering and distribution arrangement shown in FIG. 1 that only one flow control valve 36 be in "On" position at any given time, so that at any given time there can be hydraulic flow through only one flow control valve 36.

DESCRIPTION OF EMBODIMENT OF FIGS. 4 AND 5

Figure 4:
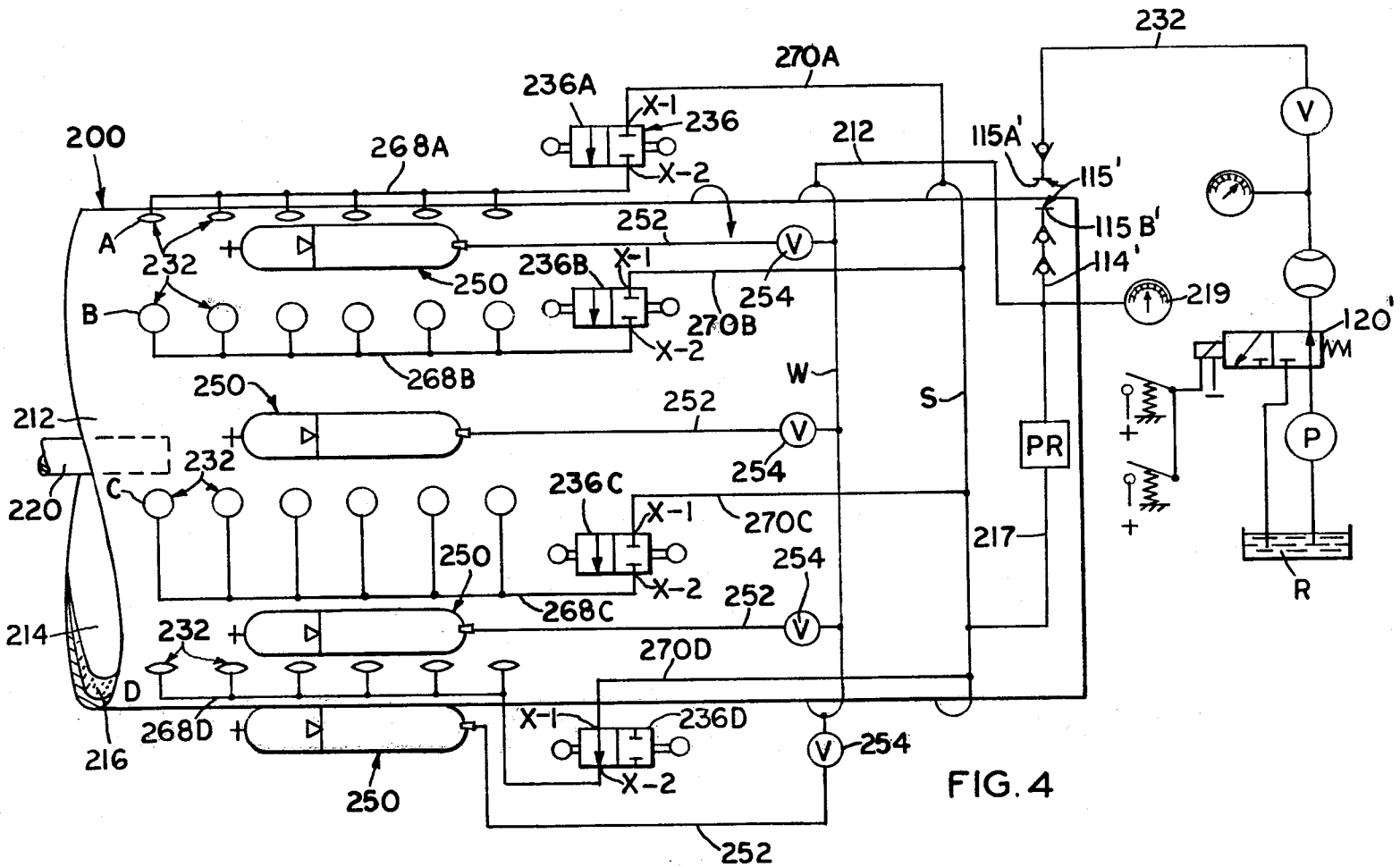
FIG. 4 is a view in elevation, partially schematic, of a rotary reduction kiln provided with a liquid fuel storage and distribution arrangement in accordance with the invention, but without the liquid metering arrangement of FIG. 1.

Referring now to FIG. 4, there is shown a view in elevation, partially schematic, of an embodiment of the invention generally similar to the embodiment of FIGS. 1–3, inclusive, but in which the metering arrangement for the liquid fuel is not used. Thus, there is shown in FIG. 4 a rotary reduction kiln generally indicated at 200 which comprises an elongated cylindrical body portion 212 which defines a cylindrical reduction or combustion chamber 214. A main burner 220 is provided at the left-hand of the kiln 200 relative to the view shown in FIG. 4 to preheat the kiln, as in the case of the embodiment of FIGS. 1–3. Main burner 220 is preferably stationary and kiln 200 rotates with respect to the stationary burner. The construction or arrangement of main burner 220 has no connection or relation with the present invention.

A plurality of inlet nozzles 232 are mounted on kiln 200, each nozzle 232 extending from the exterior of kiln 200 through the refractory wall 216 of the kiln and into communication with the interior of the kiln where the nozzles are so positioned as to inject the hydrocarbon liquid such as fuel oil into the bed of ore or pellets as the respective nozzles rotate or pass under the bed of material being reduced, in the same manner as described in connection with the embodiment of FIGS. 1–3. The plurality of nozzles 232 in the particular embodiment shown and described in connection with FIG. 4 are arranged in eight rows A–H, inclusive (only rows A–D, inclusive, are shown in FIG. 4), extending longitudinally of the kiln in a direction parallel to the axis of rotation of the kiln, with the respective rows of nozzles being arcuately spaced apart 45 degrees from each other relative to the circumference or periphery of the kiln in the same manner as described in connection with the embodiment of FIGS. 1–3. Each of the axially extending rows of nozzles in the illustrated embodiment is shown as including six nozzles. The plurality of nozzles in a given row, such as row A, are connected to and receive liquid hydrocarbon from a fluid manifold such as that indicated at 268A for row A. A flow control valve generally indicated at 236 is provided for each row of nozzle A, B, etc. and is mounted on and rotatable with kiln 200. The respective flow control valves 236 control the flow of liquid fuel to the nozzles 232 in a corresponding longitudinal row of nozzles, such as row A, B, etc. The specific flow control 236 for each of the respective rows A, B, etc. is designated by the reference numeral "236" together with a letter corresponding to the row of nozzles controlled by the particular flow control valve, as, for example, 236A, 236B, 236C, etc.

Figure 5:
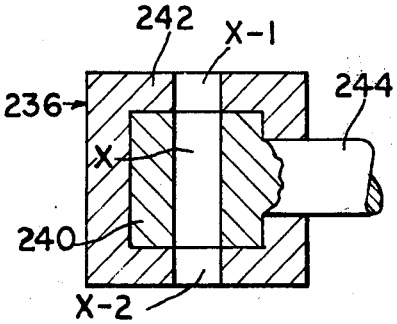
FIG. 5 is a view in longitudinal section of a flow control valve used in connection with the liquid storage and distribution arrangement of FIG. 4.

As best seen in the view of FIG. 5, valve 236 in the illustrated embodiment for use with the fuel distribution system of FIG. 4 comprises a cylindrical spool member 240 which is received within and adapted to rotate within a housing or casing 242. Spool member 240 includes a stem portion 244 which extends through the end wall of casing 242. Suitable seal or packing means (not shown) prevents leakage where stem portion 244 extends through casing 242. Valve 236 is provided with a single liquid flow passage indicated at X which extends diametrically through spool 240. Valve casing 242 includes a pair of aligned diametrically opposite ports indicated at X-1 and X-2 which are adapted to align with passage X in the rotatable spool member 240 when spool 240 is in the position shown in the view of FIG. 5, and also when spool 240 is rotated 180 degrees from the position shown in the view of FIG. 5. An operating member or cam plate (not shown) but similar to the cam plate 46 shown and described in connection with the embodiment of FIGS. 1–3 is attached to the outer end of stem portion 244 and includes four radially extending cam arms similar to the cam arms 46-1, 46-2, 46-3 and 46-4 of cam plate 46. The cam plate with the four cam arms mounted on stem portion 244 of flow control valve 246 cooperates with trip members such as those indicated at 70 and 72 in FIG. 2 to cause the rotation of valve spool 240 within valve housing 242 whereby to control the flow of liquid fuel through each of the flow control valves 236A, 236B, etc., as the respective rows A, B, of nozzles 232 pass beneath the charge of metallic oxide in the rotating kiln.

A plurality of hydro-pneumatic accumulators generally indicated at 250 similar to the accumulators 100 previously described in connection with the embodiment of FIGS. 1-3, inclusive, are mounted on the exterior surface of rotary kiln 200 in arcuately or circumferentially spaced relation to each other in the same manner as described in connection with the embodiment of FIGS. 1-3, accumulators 250 rotating with kiln 200. The plurality of accumulators 250 are each respectively connected to a circular manifold W through a corresponding connecting line or conduit 252, with a corresponding shut-off valve 254 being positioned in series with each of the connecting lines 252 between each respective accumulator 250 and circular manifold W.

The liquid fuel supply such as liquid hydrocarbon or fuel oil which is supplied to the plurality of accumulators 250 mounted on rotary kiln 200 is derived from a stationary supply source including a reservoir R, a pump P, a solenoid valve 120', all of which are similar to the previously described embodiment of FIGS. 1-3. When the accumulators require recharging with liquid hydrocarbon, the fuel supply in FIG. 4 is connected to the rotating kiln through a quick detachable coupling generally indicated at 115' including a coupling section 115A' at the end of a high pressure flexible hose 232 and a coupling section 115B' mounted on the rotating kiln, all in the same manner as described in the embodiment of FIGS. 1-3, inclusive.

The manifold W which is connected to the plurality of hydro-pneumatic accumulators 250 is connected by a conduit 212 to the input line 114' between the kiln-mounted hydraulic coupling section 115B' and the pressure regulating device PR in the same manner as described in connection with the embodiment of FIGS. 1-3. A pressure gauge 219 measures the hydraulic pressure at the junction between conduit 212 leading from accumulators 250 and conduit 114 leading to pressure regulator PR, as in the embodiment of FIGS. 1-3, inclusive.

The liquid hydrocarbon at a predetermined regulated low hydraulic pressure passes through conduit 217 from adjustable pressure regulator PR to liquid supply manifold S.

When accumulators 250 are in liquid feeding relation to nozzles 232 of kiln 200 in the embodiment of FIG. 4, the high pressure hydraulic liquid from the accumulators 250 passes through the pressure regulator device PR before passing into the circular manifold S, whereby the high pressure liquid fuel which typically may initially be at a hydraulic pressure of 1500 pounds per square inch in the accumulators 250 is reduced to a pressure of the order of magnitude of 10 to 15 pounds per square inch by the adjustable pressure regulating device PR, so that the liquid fuel in circular manifold S is at a relatively low hydraulic pressure such as 10 to 15 pounds per square inch, for example, all in the same manner as described in connection with the embodiment of FIGS. 1-3, inclusive.

Also, the adjustable pressure regulating device PR in FIG. 4 serves to maintain a substantially constant output pressure despite the decreasing output pressure from accumulators 250 as the liquid hydrocarbon content of the accumulators diminishes, the constant output pressure maintained by pressure regulating device PR maintaining a predetermined rate of liquid flow to nozzles 232.

As noted in FIG. 4, the port X-1 of each of the flow control valves 236A, 236B, 236C, etc. is connected by a corresponding conduit 270A, 270B, 270C, etc. to the liquid supply manifold S. Also, the port X-2 of each of the flow control valves 236A, 236B, etc. is connected by a corresponding conduit or manifold 268A, 268B, etc. to a corresponding one of the banks of nozzles A, B, C, D, etc.

As previously explained, each one of the flow control valves 236A, etc. has mounted on the stem portion 244 thereof a cam plate similar to the cam plate 46 shown in the view of FIG. 2 and the cam plate of each of the respective flow control valves 236 cooperates with the "On" and "Off" trip members 70 and 72 in the same manner as previously described in connection with the embodiment of FIGS. 1-3, inclusive. Thus, as each respective row A, B, C, etc. of nozzles 232 moves to a predetermined position underneath the bed 18 of metallic oxide, one of the cams such as 46-1, 46-2, etc. of the cam plate associated with each respective flow control valve 236A, 236B, engages the abutment defined by "On" trip member 70. The engagement of cam plate 46 with "On" trip member 70 causes a 90 degree circumferential movement of the cam plate to cause the corresponding flow control valve 236 to be circumferentially moved to an "On" flow conducting position in which valve passage X communicates with ports X-1 and X-2 of the valve housing to permit flow of liquid fuel from manifold S which is connected to port X-1 to the corresponding maniold 268A, 268B, etc. which is connected to the X-2 port of the respective flow control valve 236, whereby to deliver hydrocarbon fuel or the like to the corresponding bank of nozzles 232 as long as the respective and corresponding flow control valve 236 remains in an "On" position. As the kiln continues to rotate beneath the bed of metallic oxide 18, a cam of the given cam plate associated with the particular flow control valve 236A, etc. engages the "Off" trip member 72 to cause a 90 degree circumferential movement of the given cam plate and of the corresponding flow control valve 236 to move the flow control valve 236 to closed position whereby to terminate flow of the hydrocarbon liquid through the given flow control valve and through the corresponding row of nozzles.

Thus, in the arrangement shown in FIG. 4 as each row of nozzles A, B, C, etc. passes under the bed 18 of metallic oxide, the corresponding flow control valve 236 will be actuated first to "On" position and then, after a predetermined interval, to "Off" position whereby to cause each row of nozzles A, B, C, etc. to inject hydrocarbon fuel from manifold S into the bed of metallic oxide as the particular row of nozzles passes under the bed 18 of material.

Since the rotary spool 240 of each flow control valve 236 corresponding to a given row of nozzles is indexed through a total of 180 degrees in making one pass under the bed of material, due to the 90 degree motion imparted to valve 236 by each of the stationary trip members 70 and 72, the rotary valve element 240 will be in proper rotary position for the next successive pass under the bed 18 of material on the next revolution of rotary reduction kiln 200.

From the foregoing description of the invention, it has been shown how the objects of the invention have been obtained in a preferred manner. However, modifications and equivalents of the disclosed concepts such as readily occur to those skilled in the art are intended to be included within the scope of this invention.

The embodiments of the invention in which an exclusive property or privilege is claimed are defined as follows:

1. A rotary reactor comprising an elongated cylindrical chamber adapted to have a charge of material contained herein upon which a process is being performed in said chamber, a nozzle mounted on and supported by said rotary reactor in fluid communication with said chamber and adapted to dispense a liquid into said chamber required in connection with said process, a hydraulic flow control valve associated with said nozzle to control hydraulic flow to said nozzle, said flow control valve being mounted on and rotatable with said rotary reactor, a hydro-pneumatic accumulator mounted on and rotatable with said rotary reactor, said accumulator including a pneumatic section adapted to receive a pneumatic fluid and a hydraulic section adapted to receive a liquid, said pneumatic section being precharged to a predetermined pneumatic pressure whereby to exert pressure on liquid in said hydraulic section, means hydraulically connecting said hydraulic section of said accumulator to said nozzle through said flow control valve whereby to provide a liquid supply to said nozzle when said flow control valve is in "On" position, a pressure regulating means mounted on and rotatable with said rotary reactor and interposed in the liquid flow path between said accumulator and said flow control valve whereby to maintain a liquid flow rate to said flow control valve of a substantially constant predetermined value when said flow control valve is in an "On" position, conduit means carried by said rotary reactor and in hydraulic communication with said accumulator, said conduit means terminating in a quick detachable connector adapted to detachably engage a stationary source of liquid supply positioned off said rotary reactor, whereby to permit charging said accumulator with liquid, said conduit means being detachable from said stationary source to terminate flow of said liquid from said stationary source of liquid supply to said accumulator.

2. A rotary reactor as defined in claim 1 in which said conduit means carried by said rotary reactor comprises a first quick detachable connector, and said stationary source of fluid supply includes a flexible conduit means terminating in a second quick detachable connector, said first and said second quick detachable connectors being detachably engageable with each other to permit charging said accumulator with fluid from said stationary source of fluid supply.

3. A rotary reactor as defined in claim 2 in which said first and said second quick detachable connectors are adapted to be detachably engaged with each other and to be subsequently detached from each other while said rotary reactor is slowly rotating, and in which said flexible conduit means is adapted to remain in fluid communication with said accumulator during a substantial portion of one revolution of said rotary reactor while said reactor is rotating, and while said first and said second quick detachable connectors are engaged with each other.

4. A rotary reactor as defined in claim 1 in which said hydro-pneumatic accumulator is of the floating piston type.

5. A rotary reactor as defined in claim 1 in which said rotary reactor is a rotary reduction kiln adapted to receive a charge of metallic oxide which is to be reduced to a lower state of oxidation, and said fluid is a liquid hydrocarbon which serves as a reductant to reduce the state of oxidation of said metallic oxide.

6. A rotary reactor as defined in claim 1 comprising a plurality of nozzles supported by said rotary reactor in fluid communication with said chamber, said nozzles being positioned about the periphery of said reactor in substantially equally angularly spaced relation to each other, a separate fluid flow control valve associated with and corresponding to each of said nozzles, each of said flow control valves being mounted on and rotatable with said rotary reactor, means connecting each of said nozzles to said accumulator through a flow control valve corresponding to the respective nozzle, means adapted to selectively move each flow control valve to an "On" position to permit fluid flow through said valve to its corresponding nozzle when said corresponding nozzle moves to a first predetermined circumferential position relative to the charge of material in said chamber, and to move each flow control valve to an "off" position to prevent fluid flow through said valve to its corresponding nozzle when said corresponding nozzle moves to a second predetermined circumferential position relative to the charge of material in said chamber.

7. A rotary reactor as defined in claim 6 in which said fluid is a liquid, and comprising a metering cylinder mounted on said kiln and rotatable therewith, a piston member movable in said cylinder in alternately opposite directions to deliver a predetermined measured volume of liquid from said cylinder equally in each direction of movement of said piston member, a first hydraulic circuit interconnecting each of said liquid flow control valves with said accumulator and with one end of said metering cylinder on one side of said piston member, a second hydraulic circuit interconnecting each of said liquid flow control valves with an opposite end of said metering cylinder on an opposite side of said piston member and with the nozzle corresponding to the given flow control valve, means adapted to selectively move each flow control valve to an "On" position to permit hydraulic flow through said first and said second hydraulic circuits when the given nozzle corresponding to a given flow control valve moves to said first predetermined circumferential position relative to the charge of material in said chamber, and to move each flow control valve to an "Off" position to prevent hydraulic flow through said first and said second hydraulic circuits when said given nozzle moves to said second predetermined circumferential position relative to the charge of material in said chamber, the hydraulic connections of said first and said second hydraulic circuits between said metering cylinder and the flow control valves of alternate circumferentially spaced nozzles being reversed as compared to each other whereby to cause said piston member to move in said metering cylinder in alternately opposite directions to deliver a predetermined measured volume of liquid from alternate sides of said piston to alternate circumferentially spaced nozzles.

8. A rotary reactor as defined in claim 7 including means for adjusting the stroke of said piston in said cylinder whereby to cause said piston to eject a predetermined precise quantity of liquid from said cylinder on each stroke of said piston, with said precise quantity being equal in both opposite directions of movement of said piston.

9. A rotary reactor as defined in claim 6 in which each liquid flow control valve carries a corresponding cam means, and in which said means adapted to selectively move each flow control valve to an "On" position and to an "Off" position includes an "On" trip means and an "Off" trip means respectively positioned at appropriate spaced peripheral points contiguous the path of rotation of said kiln, said "On" and said "Off" trip means being adapted to engage the cam means carried by the respective flow control valves as the respective cam means rotate past said "On" and "Off" trip means, whereby to actuate the corresponding flow control valves to "On" and "Off" position at appropriate times during the rotation of said kiln.

10. A rotary reactor as defined in claim 6 in which each of said plurality of nozzles positioned about the periphery of said reactor in substantially equally angularly spaced relation to each other lies in a corresponding row of nozzles whereby to define a plurality of rows of nozzles supported by said kiln in fluid communication with said chamber, each of said rows of nozzles extending in a direction parallel to the axis of rotation of said reactor, and each row including a plurality of nozzles spaced apart from each other in said direction, said rows being positioned about the periphery of said reactor in substantially equally angularly spaced relation to each other, a separate liquid flow control valve associated with and corresponding to each of said rows of nozzles, each of said flow control valves being mounted on and rotatable with said kiln, a metering cylinder mounted on said kiln and rotatable therewith, a piston member movable in said cylinder in alternately opposite directions to deliver a predetermined measured volume of liquid from said cylinder equally in each direction of movement of said piston member, a first hydraulic circuit interconnecting each of said liquid flow control valves with a liquid fuel supply and with one end of said metering cylinder on one side of said piston member, a second hydraulic circuit interconnecting each of said liquid flow control valves with an opposite end of said metering cylinder on an opposite side of said piston member and with the plurality of nozzles in the row of nozzles corresponding to the given flow control valve, means adapted to selectively move each flow control valve to an "On" position to permit hydraulic flow through said first and said second hydraulic circuits of the respective flow control valve when the given row of nozzles corresponding to the given flow control valve moves to a first predetermined circumferential position relative to the charge of material in said chamber, and to move each flow control valve to an "Off" position to prevent hydraulic flow through said first and said second hydraulic circuits of the respective flow control valve when said given row of nozzles moves to a second predetermined circumferential position relative to the charge of material in said chamber, the hydraulic connections of said first and said second hydraulic circuits between said metering cylinder and the flow control valves of alternate rows of nozzles being reversed as compared to each other whereby to cause said piston member to move in said metering cylinder in alternately opposite directions to deliver a predetermined measured equal volume of liquid from opposite sides of said piston to alternate rows of nozzles.

11. In combination, a rotary reactor comprising a cylindrical chamber adapted to have a charge of material contained therein upon which a process is being performed in said chamber, a nozzle mounted on and supported by said rotary reactor in hydraulic communication with said chamber and adapted to dispense a liquid into said chamber required in connection with said process, a hydraulic flow control valve in hydraulic communication with said nozzle to control hydraulic flow to said nozzle, said flow control valve being mounted on and rotatable with said rotary reactor, a hydro-pneumatic accumulator mounted on and rotatable with said rotary reactor, said accumulator including a pneumatic section adapted to receive a pneumatic fluid and a hydraulic section adapted to receive a liquid, said pneumatic section being precharged to a predetermined pneumatic pressure whereby to exert pressure on liquid in said hydraulic section, means hydraulically connecting said hydraulic section of said accumulator to said nozzle through said flow control valve whereby to provide a liquid supply to said nozzle when said flow control valve is in an "On" position, conduit means carried by said rotary reactor and in liquid communication with said hydraulic section of said accumulator, a first quick detachable connector carried by said conduit means, a stationary source of liquid supply positioned off said rotary reactor, a flexible conduit means connected to said stationary source of liquid supply, said flexible conduit means terminating in a second quick detachable connector, said first and said second quick detachable connectors being engageable with each other to permit charging said hydraulic section of said accumulator with liquid from said stationary source of liquid supply through said flexible conduit while said reactor is rotating through a substantial part of a single revolution of said rotary reactor, said first and said second quick detachable connectors being disengageable from each other at the completion of said substantial part of said single revolution of said rotary reactor and while said rotary reactor is still rotating, whereby to terminate flow of said liquid from said stationary source of liquid supply to said accumulator.

* * * * *